US007088302B2

(12) United States Patent
Louzir et al.

(10) Patent No.: US 7,088,302 B2
(45) Date of Patent: Aug. 8, 2006

(54) DEVICE FOR RECEIVING AND/OR EMITTING ELECTROMAGNETIC WAVES WITH RADIATION DIVERSITY

(75) Inventors: Ali Louzir, Rennes (FR); Philippe Minard, Saint Medard sur Ille (FR); Franck Thudor, Rennes (FR); Françoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/501,111

(22) PCT Filed: Jan. 10, 2003

(86) PCT No.: PCT/FR03/00065

§ 371 (c)(1),
(2), (4) Date: Jul. 12, 2004

(87) PCT Pub. No.: WO03/061062

PCT Pub. Date: Jul. 24, 2003

(65) Prior Publication Data

US 2005/0083236 A1 Apr. 21, 2005

(30) Foreign Application Priority Data

Jan. 14, 2002 (FR) ..... 02 00665
Feb. 8, 2002 (FR) ..... 02 01562

(51) Int. Cl.
*H01Q 13/12* (2006.01)

(52) U.S. Cl. ..... 343/769; 343/725

(58) Field of Classification Search ..... 343/725, 343/728, 767–770, 700 MS, 746
See application file for complete search history.

(56) References Cited

U.S. PATENT DOCUMENTS

| | | | | |
|---|---|---|---|---|
| 4,587,524 | A | 5/1986 | Hall | 343/729 |
| 5,124,714 | A * | 6/1992 | Harada | 343/769 |
| 5,300,936 | A * | 4/1994 | Izadian | 343/700 MS |
| 5,402,132 | A * | 3/1995 | Hall et al. | 343/725 |
| 5,402,136 | A | 3/1995 | Goto et al. | 343/729 |
| 5,714,961 | A * | 2/1998 | Kot et al. | 343/769 |
| 5,914,693 | A | 6/1999 | Takei et al. | 343/767 |
| 6,160,512 | A * | 12/2000 | Desclos et al. | 343/725 |

OTHER PUBLICATIONS

B.M. Halpem, P.E. Mayes: "The Monopole Slot as a Two-Port Diversity Antenna for UHF 1 and-mobile Radio Systems", IEEE Transactions on Vehicular Technology, vol. VT33, No. 2, May 1984, pp. 76-83.
Search Report dated Jun. 11, 2003.

* cited by examiner

*Primary Examiner*—Hoanganh Le
*Assistant Examiner*—Ephrem Alemu
(74) *Attorney, Agent, or Firm*—Joseph J. Laks; Robert D. Shedd; Brian J. Cromarty

(57) ABSTRACT

A device, applicable to the field of wireless transmission, receives and/or transmits electromagnetic waves with radiation diversity. This device comprises, on a common substrate (3), at least one antenna of the slot type (1) formed by a closed curve, known as a slot antenna, electromagnetically coupled to a first supply line (6), and an antenna radiating parallel to the substrate (2), positioned inside the slot antenna and connected to a second supply line. The first and second supply lines are connected via a switching means to means to exploit the electromagnetic waves.

12 Claims, 7 Drawing Sheets

Figure 1:
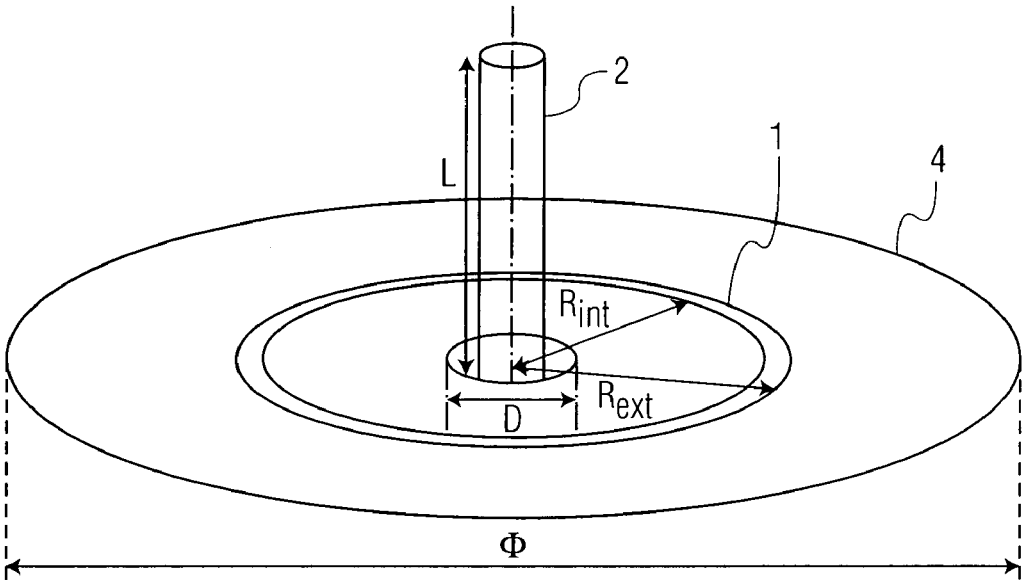

DEVICE FOR RECEIVING AND/OR EMITTING ELECTROMAGNETIC WAVES WITH RADIATION DIVERSITY

This application claims the benefit, under 35 U.S.C. § 365 of International Application PCT/FR03/00065, filed Jan. 10, 2003, which was published in accordance with PCT Article 21(2) on Jul. 24, 2003 in French and which claims the benefit of French patent application No. 0200665, filed Jan. 14, 2002 and French patent Application No. 0201562, filed Feb. 8, 2002.

The present invention relates to a device for receiving and/or transmitting electromagnetic waves with radiation diversity which can be used in the field of wireless transmissions, notably in the case of transmissions in closed or semi-closed environments such as domestic wireless networks, gymnasiums, television studios, show venues or similar places, but also in wireless communication systems requiring a minimal size for the antenna system such as in mobile telephones.

In the known high-bit-rate wireless transmission systems, the signals transmitted by the transmitter reach the receiver via a plurality of different routes. When these are combined at the receiver, the phase differences between the various radio waves having followed pathways of different lengths give rise to an interference figure which can cause a tendency to fade or a significant degradation of the signal. Moreover, the position of the tendency to fade changes over time, depending on changes in the environment, such as the presence of new objects or passing people. This tendency to fade, caused by the multiplicity of pathways, can lead to a significant degradation both in the quality of the received signal and in the performance of the system.

In order to fight against this tendency to fade, the technique most often employed is a technique known as spatial diversity. This technique consists notably of using a pair of antennas having a wide spatial coverage, such as two antennas of the "patch" type, linked to a switching unit. The two antennas are spaced out by a distance which must be greater than or equal to $\lambda 0/2$, where $\lambda 0$ is the wavelength corresponding to the operating frequency of the antenna. With this type of antenna, it can be shown that the probability of having both antennas in a fading condition simultaneously is very low. Moreover, the switching unit allows the branch connected to the antenna presenting the highest signal level to be selected by examining the received signal using a monitoring circuit. However, the main drawback with this solution is that it is relatively voluminous since it requires a minimum spacing between the radiating antennas in order to ensure an adequate decorrelation of the channel responses seen through each radiating element.

Various solutions have been proposed for reducing the size of the antenna system while still ensuring an adequate diversity. Some solutions have been the object of several patent applications filed in the name of THOMSON Multimedia Licensing S.A. They consist, notably, of using several antennas of the slot type supplied via line-slot transitions and comprising means allowing a diversity of radiation to be obtained, notably diodes allowing switching onto one or other of the antennas depending on the level of the received signal.

Furthermore, in the IEEE article, Vol. 49, No. 5 May 2001, entitled "Diversity antenna for external mounting on wireless handsets", it has also been proposed, in the field of mobile telephones, to link a $\lambda/4$ slot with a monopole to produce a diversity radiation system. However, the proposed system is a relatively complex, three-dimensional structure.

The aim of the present invention is therefore to propose a new solution for a device for receiving and/or transmitting electromagnetic waves with radiation diversity having an extremely compact structure while still exhibiting radiation patterns with a very good complementarity. It also provides a device for receiving and/or transmitting electromagnetic waves with radiation diversity having a relatively low cost of manufacture.

Consequently, the subject of the present invention is a device for receiving and/or transmitting electromagnetic waves with radiation diversity, characterized in that it comprises, on a common substrate, at least one antenna of the slot type formed by a closed curve, electromagnetically coupled to a first supply line, and an antenna radiating parallel to the substrate such as a monopole, a helix operating in transverse mode or similar, positioned inside the slot antenna and connected to a second supply line, said first and second supply lines being connected via a switching means to means for exploiting the electromagnetic waves.

The device for the reception and/or transmission of electromagnetic waves described above exploits the fact that antennas of the slot type formed by a closed curve, hereinafter referred to as slot antennas, as well as antennas of the monopolar or helical type operating in transverse mode exhibit virtually omnidirectional radiation patterns with minima situated, respectively, in the plane of the substrate for the slot antenna and along the axis of the monopole or helix for the other antenna. Thus, switching from one antenna to the other allows the channel response through the antenna to be modified and allows the system to thus benefit from a gain in diversity.

According to preferred embodiments, the first supply line is implemented in microstrip technology or in coplanar technology. Furthermore, the first supply line has a length between its end and the electromagnetic coupling point equal to $k\lambda m/4$, where k is an odd integer and $\lambda m$ the guided wavelength on the supply line at the central operating frequency with $\lambda m=\lambda 0/\sqrt{\epsilon r_{eff}}$, where $\lambda 0$ is the free-space wavelength and $\epsilon r_{eff}$ the effective permittivity of the line. The second supply line is implemented in microstrip technology or by a coaxial line. When the line is implemented in microstrip technology, a connection is made at the slot antenna between the part that is external and the part that is internal to the slot, this connection being formed, for example, by a conducting insert having a width equal to around two to three times the width of the line implemented in microstrip technology, so as not to interfere with the operation of the microstrip line providing the excitation. In addition, in order to minimize the interference within the slot of the slot antenna, owing to the presence of the conducting connection, this connection is situated in an electrical short-circuit plane for the slot which is therefore the plane where the microstrip line providing the excitation of the monopole or helical antenna crosses the slot antenna.

According to preferred embodiments, the slot antenna is formed by an annular slot of circular shape or formed by a closed curve of perimeter equal to $k'\lambda s$ where k' is an integer and $\lambda s$ is the wavelength in the slot at the operating frequency and/or by a slot of polygonal shape such as a square or rectangle. According to another feature of the present invention, the device for receiving and/or transmitting electromagnetic waves with radiation diversity may comprise several slot antennas interlocking with one another so as to widen the operating band or to allow multiband applications.

Figure 2:
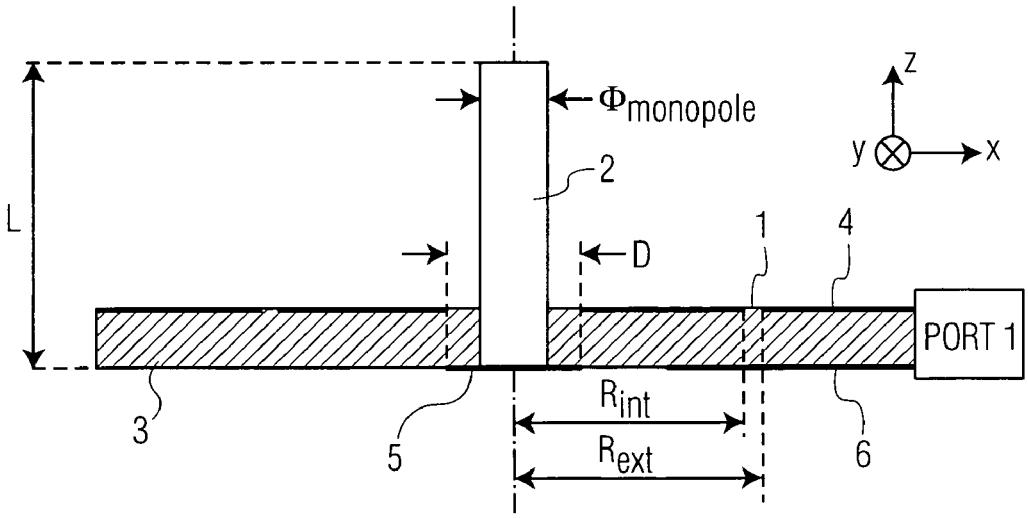
Figure 3:
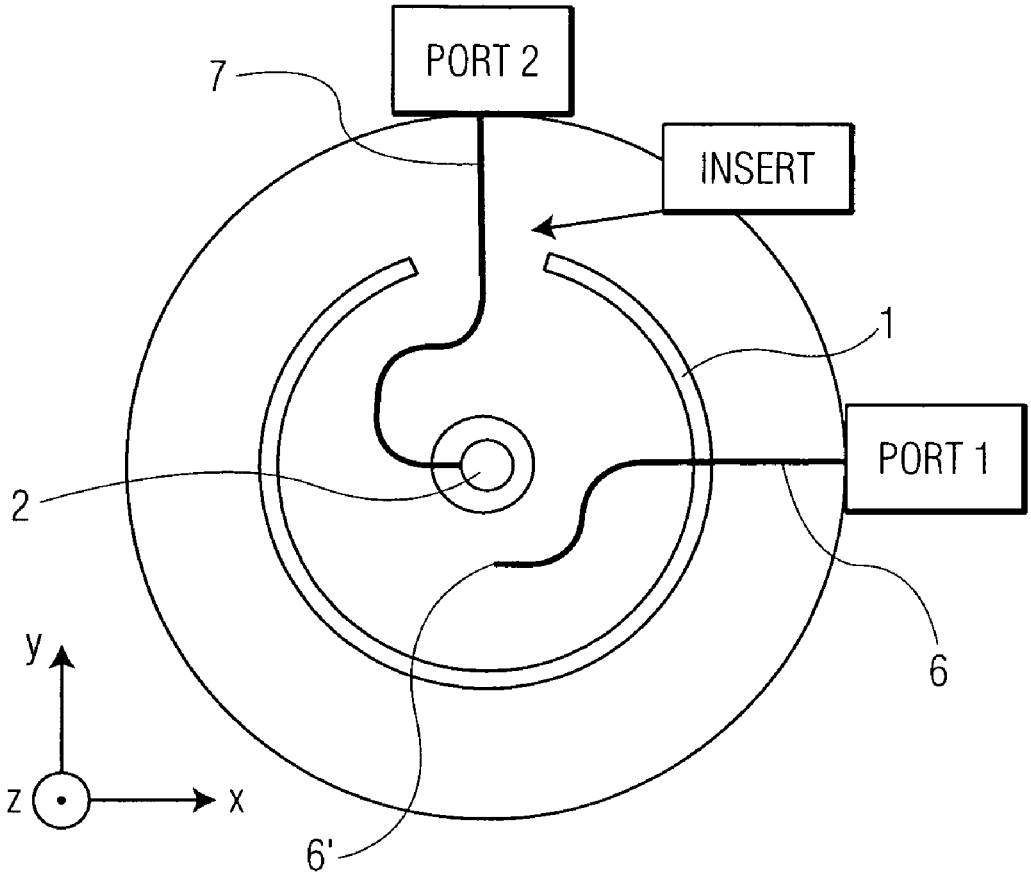
Figure 4:
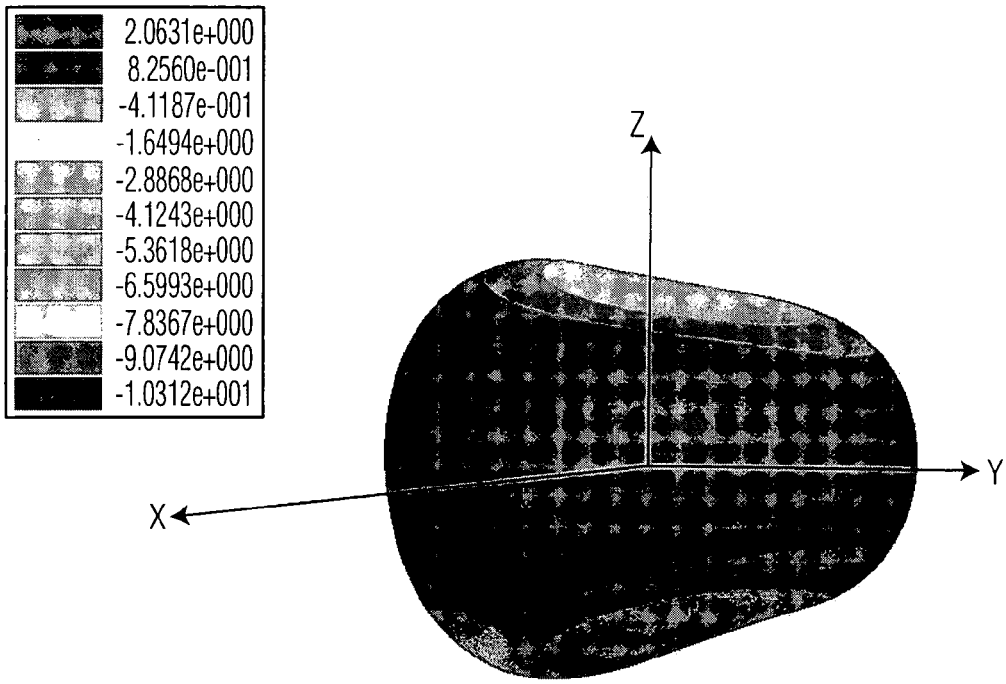
Figure 5:
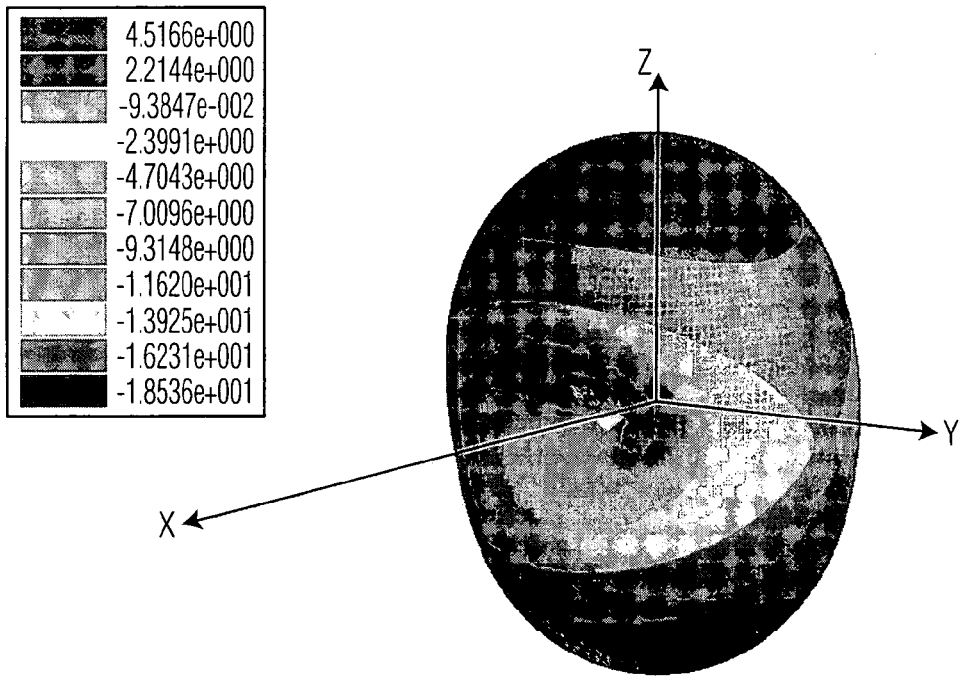
Figure 6:
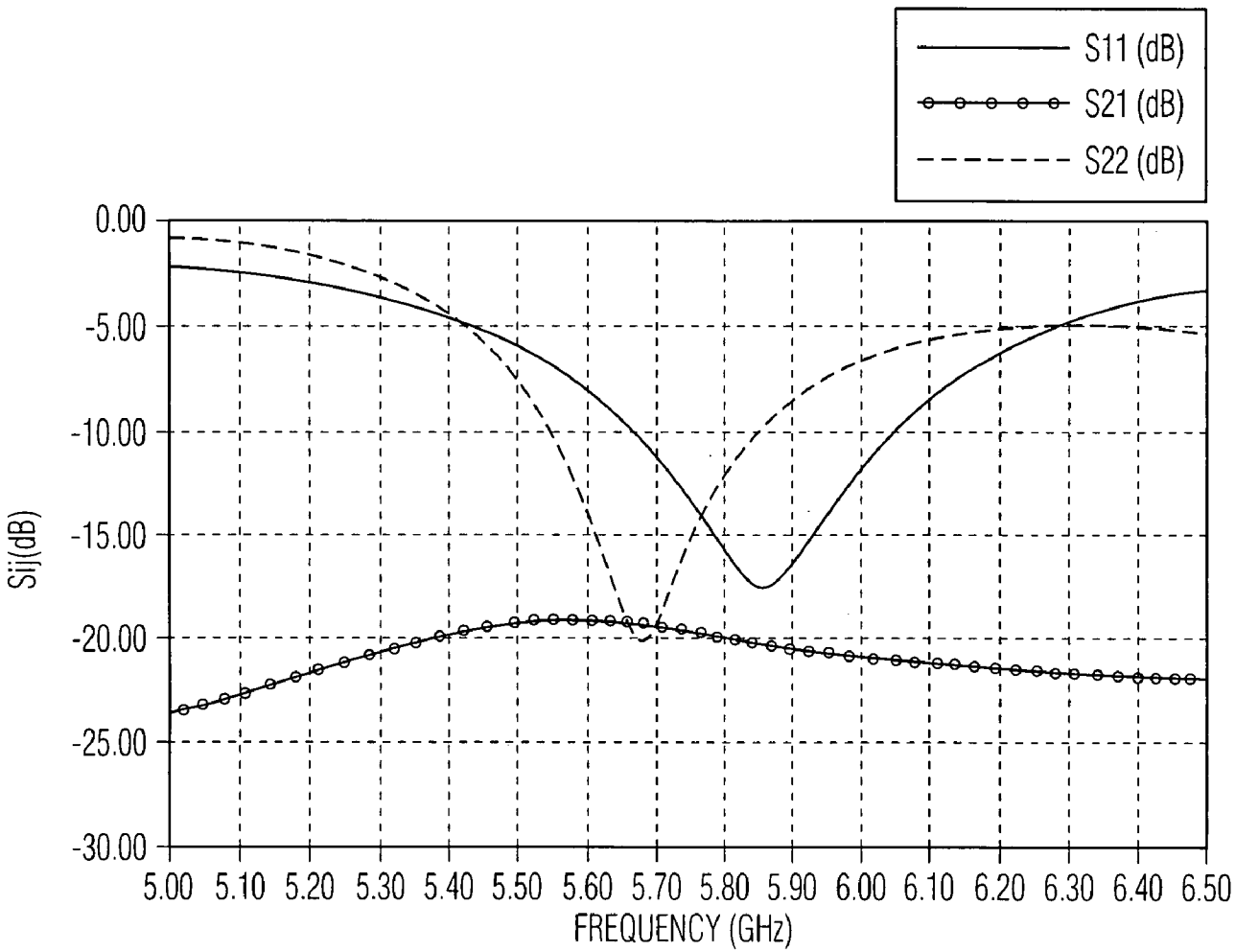
Figure 7:
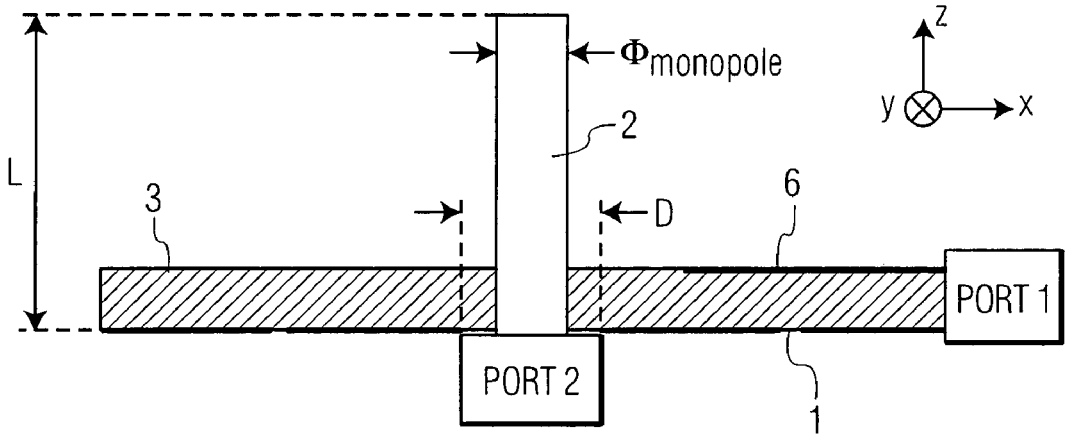
Figure 8:
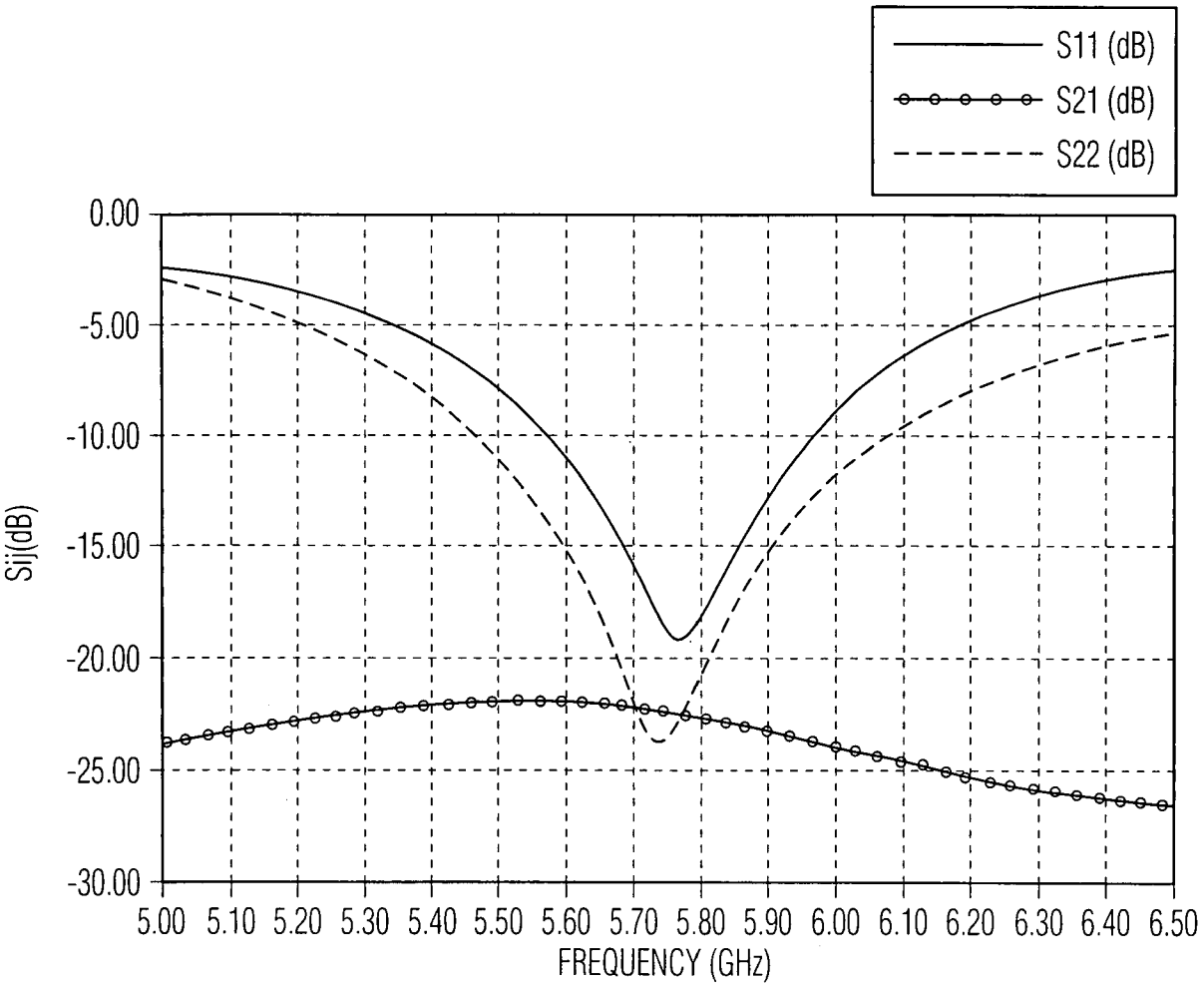
Figure 9:
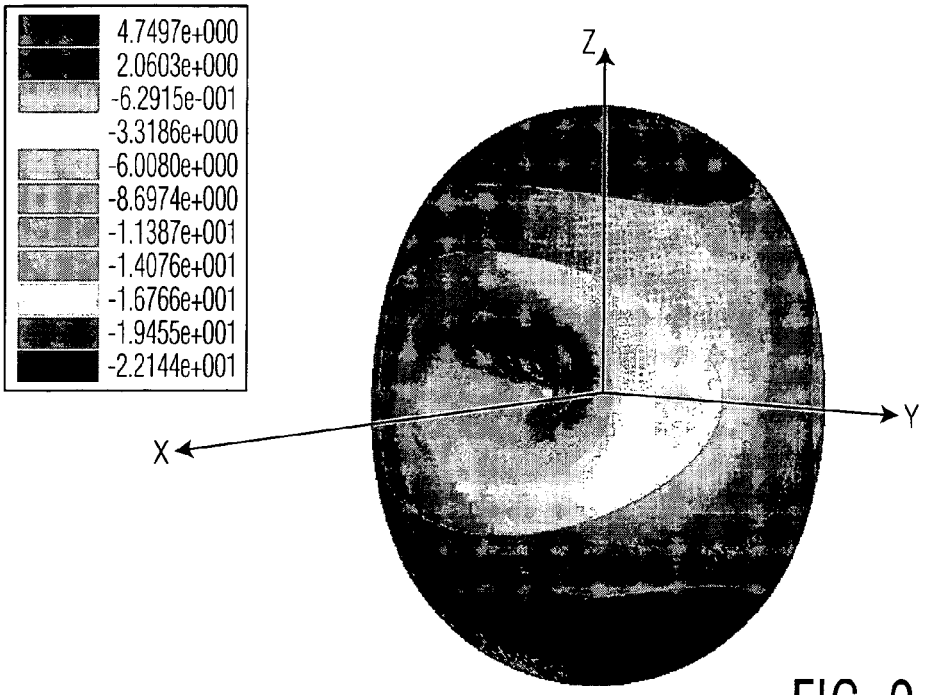
Figure 10:
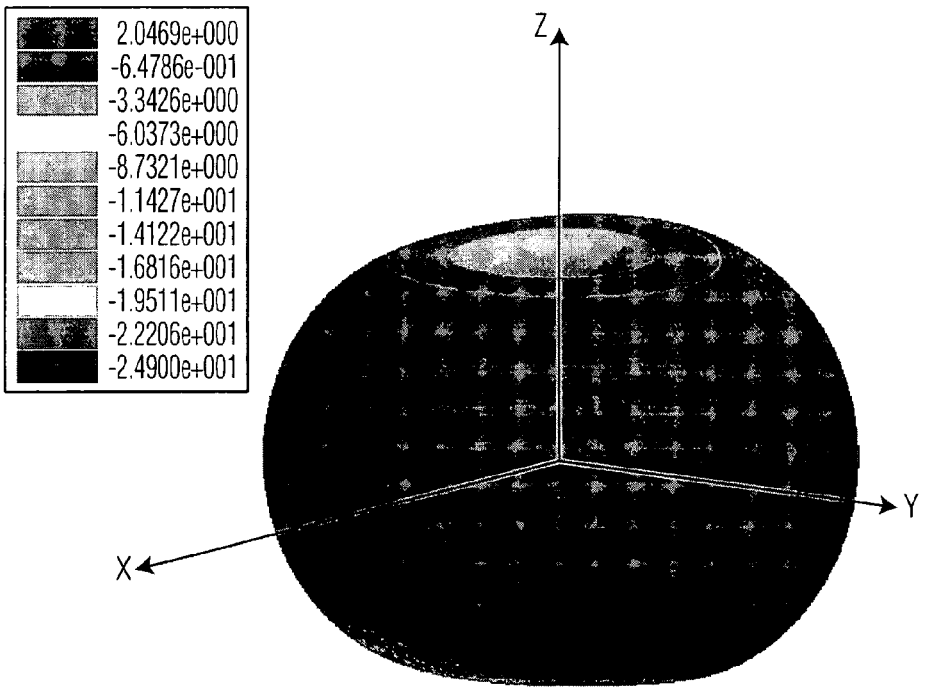

Other features and advantages of the present invention will become apparent upon reading the description of various embodiments presented with reference to the appended drawings, in which:

FIG. 1 is a schematic perspective view of a first embodiment of the present invention, FIGS. 2 and 3 are respectively a cross-sectional and a top view of the first embodiment, FIGS. 4 and 5 show perspective views of the radiation patterns of the monopole and of the slot antennas, respectively, for a device according to FIGS. 1 to 3, FIG. 6 shows a curve plotting the S parameters in dB as a function of frequency between the various "ports" for a device according to FIGS. 1 to 3, FIG. 7 is a cross-sectional view of a second embodiment of the present invention, FIG. 8 is an identical curve to that in FIG. 6 for the second embodiment, FIGS. 9 and 10 show the radiation patterns of the slot and of the monopole antennas, for a device according to FIG. 7.

In order to simplify the description, in the drawings the same elements carry the same reference numbers.

As shown in FIGS. 1 to 3, the device for receiving and/or transmitting electromagnetic waves consists essentially of a slot antenna 1 formed by a closed curve, more particularly an annular slot, and of an antenna 2 radiating parallel to the plane of the slot, namely a monopole in the embodiment shown. The monopole 2 is positioned at the center of the slot antenna 1. More specifically, as shown in FIGS. 2 and 3, the device of the present invention comprises a substrate made from dielectric material 3 whose top surface has been metallized. The annular slot 1 is fabricated by demetallization of the metallic layer 4 around a circle of diameter depending on the operating wavelength of the device, more particularly its perimeter is equal to $k'\lambda s$ where $\lambda s$ is the wavelength in the slot at the operating frequency and k' is an integer.

Furthermore, a circular opening 5 of diameter D is provided at the center of the annular slot. This opening receives the monopole 2 in its central part which also passes through the substrate 3. An annular metallic mounting disk 5 is provided on the lower face of the substrate 3 under the monopole 2. As shown more particularly in FIG. 3, the annular slot 1 is excited, according to the method described by Knorr, by a microstrip line 6 connected to the port 1. This microstrip line 6 is fabricated on the lower face of the substrate. Between its free end 6' and the electromagnetic coupling point with the slot 2, it has a length $Lm=k\lambda m/4$, where $\lambda m$ is the wavelength on the line and k is an odd integer.

Similarly, in the embodiment shown, the monopole 2 is excited by a microstrip line 7.

As shown in FIG. 3, in order to ensure continuity of the ground plane for the microstrip line 7 that excites the monopole 2, a connection is made between the internal disk and the external ring forming the annular slot 1. This connection is made by means of a conducting insert 8 of width w that is large enough (width equal to around 2 to 3 times the width of the printed line providing the excitation) so as not to interfere with the operation of the microstrip line providing the excitation. In order to minimize the interference at the annular slot from the presence of this metallic insert, the latter is located in a plane of electrical short-circuit for the slot, which will therefore be the plane where the line providing the excitation of the monopole crosses the annular slot.

As presented in FIGS. 4 and 5, the annular slot 1 and the monopole 2 exhibit radiation patterns that are virtually omnidirectional and relatively complementary in that the minima m are situated, for the annular slot, in the plane of the substrate (in this case, along the axis ox) and, for the monopole, along the axis of the latter (in this case the axis oz). Thus, switching from one port to the other (by means of a switching device that is well known to those skilled in the art, such as a switch, positioned between the supply lines 6 and 7 and the part for processing the signal, controlled by a control signal such as the signal level, the signal-to-noise ratio or similar) allows the channel response through the antenna to be modified and allows the system to thus benefit from a gain in diversity. Accordingly, if the dominant received signal arrives along the ox axis, for example, which would imply that a weak signal is received through the access connected to the slot, by switching to the access connected to the monopole, it is very probable that a signal with a substantial level will be received given that the direction ox corresponds to a maximum in the monopole pattern. A symmetric argument can be applied to the case where the dominant signal arrives along the oz axis, for example in the case of a multistage communication.

In this case, the coupling between the annular slot 1 and the monopole 2 remains weak given:

i) the complementarity of the radiation patterns (the directions of the maxima of one are in the direction of the minima of the other);

ii) the orthogonality of the fields emitted by the slot and the monopole antennas.

Minimal mutual interference can thus be expected between the two radiating elements even though they occupy almost the same physical space.

In order to ensure correct operation of a transmission/reception device such as described above, the dimensions of the latter have been completely chosen for operation at the central frequency of around 5.8 GHz then simulated using the HFSS simulation package from Ansoft. With reference to the schematic drawings in FIG. 1 to 3, the antenna system formed by an annular slot 1 and a monopole 2 has the following dimensions:

$R_{int}$=6.4 mm (internal radius of the slot)

$R_{ext}$=6.8 mm (external radius of the slot)

$W_s$=0.4 mm (width of the slot, $W_s=R_{ext}-R_{int}$)

$W_{m1}$=0.3 mm (width of the microstrip line supplying the slot)

$l_{m1}$=8.25 mm (length of the microstrip line supplying the slot between the port 1 and the line/slot transition)

$l_{m1}'$=8.25 mm (length of the microstrip line supplying the slot between the line/slot transition and the end of the line in open circuit)

D=2 mm (diameter of the demetallization at the center of the slot)

L=13.21 mm (length of the monopole)

□=30 mm (diameter of the ground plane)

$□_{monopole}$=1 mm (diameter of the metallic wire forming the monopole)

$W_{m2}$=0.2 mm (width of the microstrip line supplying the monopole)

$l_{m2}$=8.4 mm (length of the microstrip line supplying the monopole between the port 2 and the line/slot transition)

$l_{m2}'$=8.8 mm insert 1.2 mm long (or 3% of the slot length)

a metallic disk of diameter 2 mm is placed under the monopole (this facilitates the soldering of the monopole to its supply line)

The substrate used is made of Rogers 4003 with relative permittivity $_r$=3.38 and thickness h=0.81 mm.

FIG. 6 shows the simulation results of the reflection coefficients at the input of the lines supplying the annular slot (S11) and the monopole (S22) as well as the coupling coefficient (S21) between the two ports 1 and 2. A good matching of the two antennas can be observed as well as an isolation better than 19 dB between the two accesses despite the extreme proximity of the two radiating elements, namely the slot 1 and the monopole 2.

In this case, the radiation patterns obtained at the monopole and annular slot access, respectively, are those shown in FIGS. 4 and 5. Despite a slight distortion of the monopole pattern, it can be observed that the antenna system operates as desired, in other words therefore with virtually omnidirectional, complementary patterns with the minima along the oz axis for the monopole and along the ox axis for the annular slot.

According to a variant, shown in FIG. 7, the monopole is excited by a coaxial line connected at the port 2. In this variant 2, the excitation of the monopole is on the substrate ground plane 9 side. In this case, the ground plane 9 is formed on the lower surface of the substrate 3. The antenna consisting of the annular slot 1 is formed in this ground plane. The supply line formed by a microstrip line 6 is now implemented on the upper surface of the substrate, the excitation taking place as in the previous embodiment. Simulations specific to this variant have been carried out using the HFSS package from Ansoft, on a particular implementation dimensioned as follows:

$R_{int}$=6.4 mm (internal radius of the slot)

$R_{ext}$=6.8 mm (external radius of the slot)

$W_s$=0.4 mm (width of the slot, $W_s=R_{ext}-R_{int}$)

$W_{m1}$=0.3 mm (width of the microstrip line supplying the slot)

$l_{m1}$=8.25 mm (length of the microstrip line supplying the slot between the port 1 and the line/slot transition)

$l_{m1}'$=8.25 mm (length of the microstrip line supplying the slot between the line/slot transition and the end of the line in open circuit)

D=2 mm (diameter of the demetallization at the center of the slot)

L=12.4 mm (length of the monopole)

□=30 mm (diameter of the ground plane)

□$_{monopole}$=1 mm (diameter of the metallic wire forming the monopole)

The substrate used is made of Rogers 4003 with relative permittivity $_r$=3.38 and thickness h=0.81 mm.

The matching at the two accesses as well as the isolation between the two ports are shown in FIG. 8. The curve S21 shows a good isolation while the curves S11 and S22 show a good matching at the operating frequency of 5.8 GHz. FIGS. 9 and 10 present the radiation patterns, respectively at the slot and monopole access, of the device for the transmission and/or reception of electromagnetic waves described above. It can be observed that the excitation of the monopole by coaxial line, which has the advantage of avoiding the crossing of the excitation line of the monopole and the slot antenna, presents a better isolation (isolation greater than 22 dB) than in the case of the excitation by microstrip line and the monopole pattern is no longer distorted. This advantage is gained at the expense of an increase in complexity of the antenna structure (slot and monopole access on opposite faces of the substrate and of different types: coaxial line and microstrip line).

Further modifications may be included such as the use of a helix operating in the transverse mode in place of the monopole, the use of a double or multiple slot in order to widen the band or for multiband applications, tangential supply of the slot in place of a Knorr-type supply, and the deformation of the annular slot to further reduce its size, where it could also take the form of a square, a rectangle or other polygon while still remaining within the scope of the definition given above. Similarly, the monopole or helix may be replaced by antennas of the same type which can be placed at the center of the slot antenna and which radiate in a direction parallel to the substrate. The supply line of the slot antenna can be implemented as a line in microstrip technology or in coplanar technology. In addition, the slot antenna may have means, such as notches in the case of an annular slot, that allow it to operate in cross-polarization mode.

What is claimed is:

1. A device for receiving and/or transmitting electromagnetic waves with radiation diversity comprising, on a common substrate, at least a first slot antenna (i), the slot being realized in the ground plane in the form of a closed curve of perimeter equal to k'λs where λs is the wavelength in the slot at the operating frequency and k' is an integer, said first antenna being electromagnetically coupled to a first supply line, and a second antenna radiating in a direction parallel to the substrate, said second antenna being positioned inside the curve forming the first antenna and being connected to a second supply line, said first and second supply lines being connected via a switching means to means for exploiting the electromagnetic waves.

2. The device as claimed in claim 1, wherein the second antenna radiating parallel to the substrate is formed by a monopole or a helix operating in transverse mode.

3. The device as claimed in claim 1, wherein the second antenna radiating parallel to the substrate is positioned at the center of the slot antenna or antennas.

4. The device as claimed in claim 1, wherein the first supply line is implemented in microstrip technology or coplanar technology.

5. The device as claimed in claim 4, wherein the first supply line has a length between its end and the electromagnetic coupling point equal to kλm/4, where k is an odd integer and λm the guided wavelength on the supply line at the central operating frequency with $\lambda m=\lambda O/\sqrt{\epsilon r_{eff}}$, where λO is the free-space wavelength and $\epsilon r_{eff}$ the effective permittivity of the line.

6. The device as claimed in claim 1, wherein the first slot antenna is formed by an annular slot or a slot of polygonal shape such as a square or rectangle.

7. The device as claimed in claim 6, wherein the first slot antenna comprises several antennas of slot type interlocking one with another.

8. The device as claimed in claim 1, wherein the second supply line is implemented in microstrip technology or by a coaxial line.

9. The device as claimed in claim 8, wherein when the second supply line is implemented in microstrip technology, a connection is made at the slot antenna between the part that is external and a part that is internal to the slot.

10. The device as claimed in claim 9, wherein the connection is positioned in an electrical short-circuit plane for the slot.

11. The device as claimed in claim 9 wherein the connection is formed by a conducting insert having a width equal to 2 to 3 times the width of the line implemented in microstrip technology.

12. The device as claimed in claim 11, wherein the insert is positioned in an electrical short circuit plane for the slot.

* * * * *